US010144557B2

(12) United States Patent
Bischoff et al.

(10) Patent No.: US 10,144,557 B2
(45) Date of Patent: Dec. 4, 2018

(54) STACKABLE LID OF A CONTAINER

(71) Applicant: Mauser-Werke GmbH, Brühl (DE)

(72) Inventors: Sebastian Bischoff, Bonn (DE); Daniel Siede, Pulheim (DE)

(73) Assignee: Mauser-Werke GmbH, Brühl (DE)

( * ) Notice: Subject to any disclaimer, the term of this patent is extended or adjusted under 35 U.S.C. 154(b) by 0 days.

(21) Appl. No.: 15/511,153

(22) PCT Filed: Sep. 15, 2015

(86) PCT No.: PCT/EP2015/001842
§ 371 (c)(1),
(2) Date: Mar. 14, 2017

(87) PCT Pub. No.: WO2016/041633
PCT Pub. Date: Mar. 24, 2016

(65) Prior Publication Data

US 2017/0275058 A1 Sep. 28, 2017

(30) Foreign Application Priority Data

Sep. 15, 2014 (DE) ..... 10 2014 013 328

(51) Int. Cl.
*B65D 43/02* (2006.01)
*B65D 21/02* (2006.01)

(52) U.S. Cl.
CPC ..... *B65D 43/021* (2013.01); *B65D 21/0219* (2013.01); *B65D 2543/00027* (2013.01);
(Continued)

(58) Field of Classification Search
CPC .. B65D 43/021; B65D 43/0204; B65D 45/16; B65D 21/0204; B65D 21/0201;
(Continued)

(56) References Cited

U.S. PATENT DOCUMENTS 3,448,888 A 6/1969 Smith et al.
4,286,713 A 9/1981 Marchais
(Continued)

FOREIGN PATENT DOCUMENTS

DE 30 01 656 7/1980
DE 197 32 979 2/1999
(Continued)

OTHER PUBLICATIONS

International Search Report issued by the European Patent Office in International Application PCT/EP2015/001842 dated Nov. 19, 2015.

*Primary Examiner* — Robert J Hicks
(74) *Attorney, Agent, or Firm* — Henry M. Feiereisen LLC

(57) ABSTRACT

A lid for a container includes snap-fit hooks for interlocking engagement in complementing latching openings of an outwardly projecting flange of a jacket of the container, and stacking parts disposed on a lower side of the lid close to the periphery for form-fitting engagement in complementing stacking parts on an upper side of a further said lid, when the lids are stacked. The lower side of the lid and the upper side of the further lid have each a central region that forms a contact area via which compressive forces are transmissible in the presence of a contact between the contact areas of the lower side of the lid and the contact area of the upper side of the further lid.

14 Claims, 5 Drawing Sheets

Figure 1:
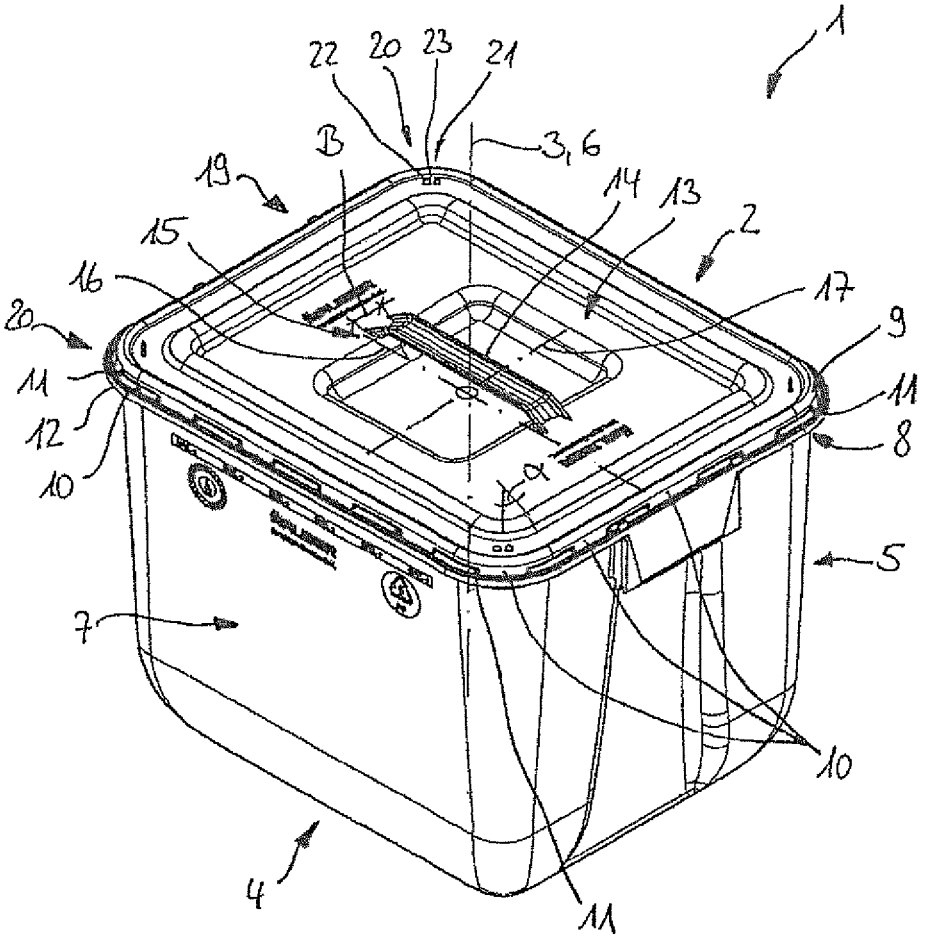

(52) U.S. Cl.
CPC ..... *B65D 2543/00101* (2013.01); *B65D 2543/00194* (2013.01); *B65D 2543/00666* (2013.01); *B65D 2543/00694* (2013.01); *B65D 2543/00759* (2013.01); *B65D 2543/00768* (2013.01); *B65D 2543/00805* (2013.01); *B65D 2543/00851* (2013.01)

(58) Field of Classification Search
CPC ..... B65D 21/0217; B65D 21/0219; B65D 21/0222; B65D 21/0223; B65D 21/0215
USPC ..... 220/781, 780, 380, 324, 315; 206/511, 206/509, 508, 505, 504
See application file for complete search history.

(56) References Cited

U.S. PATENT DOCUMENTS

| | | | |
|---|---|---|---|
| 9,233,777 | B2 | 1/2016 | Weyrauch et al. |
| 2015/0239608 | A1 | 8/2015 | Weyrauch et al. |

FOREIGN PATENT DOCUMENTS

| | | |
|---|---|---|
| EP | 0 176 904 | 4/1985 |
| EP | 0 168 877 | 1/1986 |
| GB | 2 261 359 | 5/1993 |
| WO | WO 2006/091663 | 8/2006 |
| WO | WO 2007/139377 | 12/2007 |

14
22
23
21
2
18
10

25
30,32
31
33
25
18
2
24
25
33
25

2
33

2
26
27
27
26

2
25

21
2
28,29
19
14

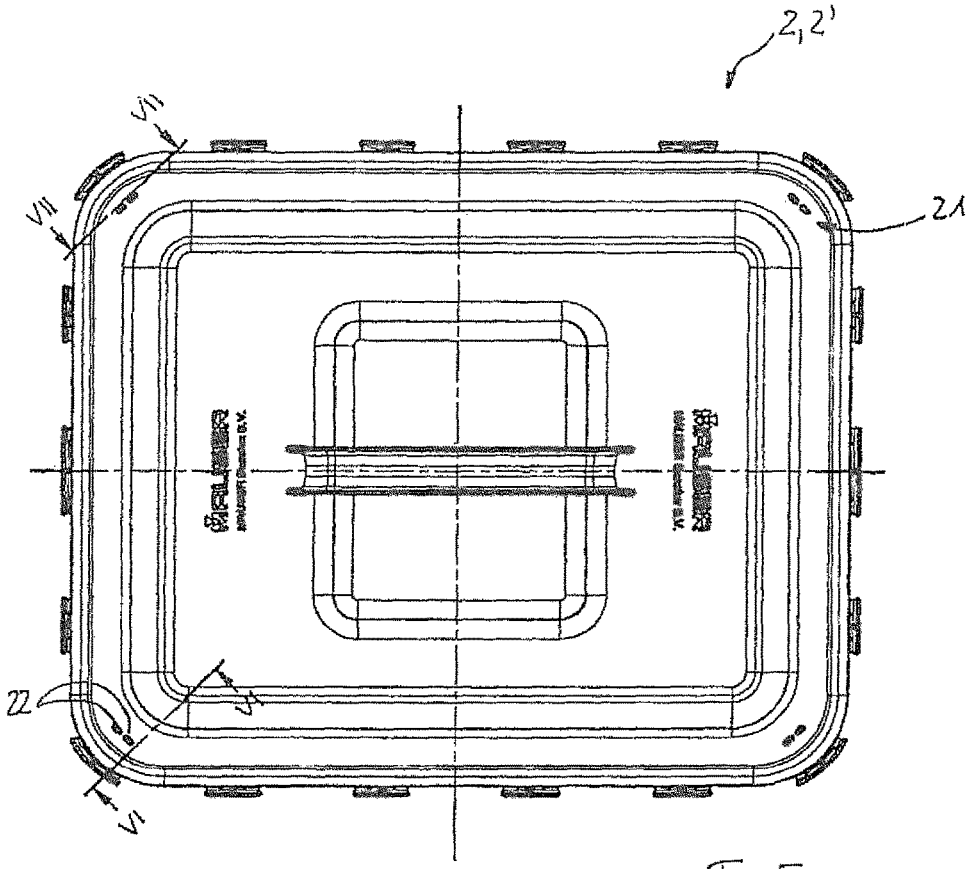
Fig. 5
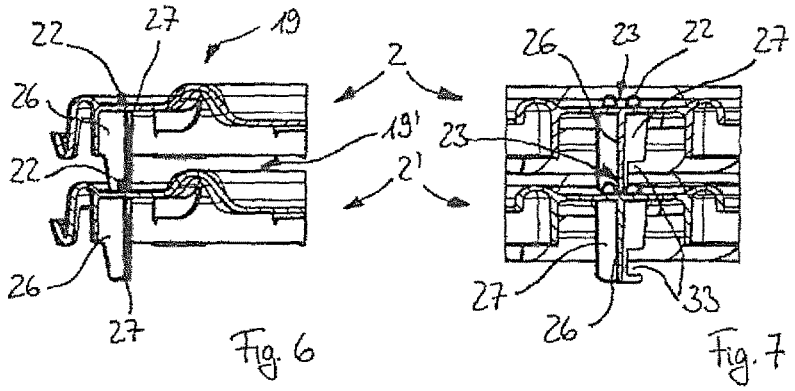
Fig. 6
Fig. 7

STACKABLE LID OF A CONTAINER

CROSS-REFERENCES TO RELATED APPLICATIONS

This application is the U.S. National Stage of International Application No. PCT/EP2015/001842, filed Sep. 15, 2015, which designated the United States and has been published as International Publication No. WO 2016/041633 A1 which claims the priority of German Patent Application, Serial No. DE 10 2014 013 328.1, filed Sep. 15, 2014, pursuant to 35 U.S.C. 119(a)-(d).

INTRODUCTION

The invention relates to a lid of a container, wherein the container has a base, a vertical axis which is aligned so as to be perpendicular to the base, a jacket which adjoins the base in an encircling manner and encloses an interior space of the container, and an opening cross section which is defined by an end of the jacket that faces away from the base and is tightly closable by means of the lid, wherein the lid is provided with snap-fit hooks which are disposed in an encircling manner and so as to be mutually spaced from one another on the periphery of said lid, and which are hook-fittable to latching openings which are adapted to said snap-fit hooks and which are likewise disposed in an encircling manner and so as to be mutually spaced from one another in a peripheral flange of the container which projects outwardly from the jacket of the container, while forming a form-fit which prevents movement of the lid in the direction of the vertical axis of the container, wherein the lid on a lower side that faces the interior space of the container is provided with stacking male parts or stacking female parts which are disposed close to the periphery and are distributed on the circumference of the lid and which, in the closed state of the container, extend in the direction of the interior space of the container, and which stacking male parts or stacking female parts are capable of being engaged in stacking female parts or stacking male parts, respectively, on an upper side of a lower lid, which are adapted to said stacking male parts or stacking female parts and which cause a form-fit which prevents movement of the lid in the direction which is perpendicular to a vertical axis of the lid that is congruent with the vertical axis of the container, when two identical lids are stacked on top of one another, wherein compressive forces by way of the mutually engaged stacking male parts and stacking female parts are transmissible in the direction of the vertical axis of the lid.

PRIOR ART

Containers are employed in a versatile manner and in particular serve for storing, collecting, and disposing of substances or materials, containers being known in a wide range of sizes and shapes. Waste containers which are provided for employment in hospitals, veterinary clinics, medical and dental practices, and in medical research and development laboratories, where in particular infectious waste arises, are used only once or are disposed of together with the waste located therein, respectively, once said containers have been tightly closed in a suitable manner. For this reason, it is necessary in these fields of application to keep handy a correspondingly high number of new empty containers which for space reasons have to be stackable, that is to say placeable in one another. Accordingly, empty containers, on the one hand, and the associated lids which are typically delivered on a separate pallet, on the other hand, are thus stacked. In order for space utilization to be improved in the case of palletized transportation, one strives at all times to correspondingly optimize the geometric design of the lids. However, in this context it must be considered that there is the risk that the stacked lids, in particular the lids lying at the bottom, are distorted in such a manner that said lids may no longer be utilized for tight closing. However, this is essential in the case of the aforedescribed application case of a container for infectious waste.

OBJECT

It is an object of the present invention to refine a lid of the aforementioned type in such a manner that said lid is distinguished by comfortable stackability and low susceptibility to distortion.

ACHIEVEMENT

Proceeding from the lid mentioned at the outset, this object is achieved in that in the state of two lids stacked on top of one another a contact area is configured both on the lower side of the upper lid as well as on the upper side of the lower lid in each case in a central region of the respective lid, and in that compressive forces by way of contact between these two contact areas are transmissible in the direction of the vertical axis of the lids.

In the prior art the stacking male parts or stacking female parts are distributed close to the periphery on the circumference of the lid such that the lid periphery is substantially stressed for load transfer of the dead weight of stacked lids. Therefore, it is lids which are located at the bottom of the stack in particular which thus tend to be deformed. By way of the arrangement of a central contact area according to the invention, load transfer thus also takes place in a central region of the lids, this effectively counteracting distortion of the lid. On account thereof, the quality of the lids is preserved and tight closing of a container is guaranteed, providing there is orderly handling. Here, it is particularly purposeful when the central contact area also has a load-transferring effect, that is to say is in contact with the sub-base, when the lid is placed onto a planar sub-base. In this case, the lower sides of as far as possible all stacking male parts and/or stacking female parts and of the central contact area are thus disposed in the same plane.

Accordingly, it is advantageous for the stacking male parts or stacking female parts which face the interior space of the container, and the contact area which is located on the lower side of the lid, to have bearing faces which are located in the same plane perpendicular to the vertical axis. For example, if a lid has four stacking male parts on the lower side and has the central contact area, the lid at five points bears either on a lid located therebelow or on a sub-base or floor, respectively.

Advantageously, the lid according to the invention has stacking male parts on the lower side of the lid that have a T-shaped cross section and are each capable of being engaged in stacking female parts having a slot on the upper side of a lid which is located therebelow in such a manner that a free web of the T-shaped cross section of the stacking male parts enters into the slot of the stacking female parts. This configuration of the stacking male parts and stacking female parts is distinguished by a small material input and is thus more cost-effective than the stacking installations which are known from the prior art and are configured so as to be comparatively large. Moreover, stacking with an extremely precise fit is made possible by the configuration of the stacking male parts and stacking female parts according to the invention, this counteracting any potential tilting of a stack of lids.

It may furthermore be advantageous if the free webs of the stacking male parts which in the cross section are T-shaped point away from the vertical axis of the lid, and preferably run at an angle of 40° to 50° in relation to a transverse axis or to a longitudinal axis of the lid.

According to one design embodiment of the lid according to the invention it is provided that the contact area in the central region on the upper side of the lid is formed by a handle by which the lid or the container which is closed by the lid, respectively, is liftable, wherein the contact area which is located on the lower side of the lid in the central region thereof is preferably formed by a lower side of a depression emanating from the upper side of the lid, said depression enabling the handle to be engaged from below by hands. In this manner, the handle of the lid is utilized as a contact area such that the provision of a separate central contact area may be dispensed with. Elements which are anyway located on the lid are thus configured as a contact area.

In this context it makes sense for the contact area on the lower side of the upper lid, and the contact area on the upper side of the lower lid to be each configured so as to be elongate, wherein two contact areas which run parallel with one another on the upper side of the lower lid are preferably formed by peripheries of the handle that interact with two correspondingly configured contact areas on the lower side of the upper lid. The handle often has a U-shaped cross section having two webs and one flange, the two webs being directed away from the lid surface such that the elongate contact areas on the upper side of the lid are formed by the surfaces of the webs and thus run in a linear manner.

With a view to the actual use of the lid and the provision of the latter for closing a container, it is of advantage for at least one, preferably at least two, preferably all stacking male parts which are disposed on a lower side of the lid, preferably in a strap of the stacking male part which in the cross section is T-shaped, to be each provided with a recess which allows the lid to be hooked into one or preferably two latching openings in the peripheral flange of the container, or on an end portion of the jacket of the container. When providing a required container, the associated lid may thus already be fastened to the container such that a subsequent search for said lid is dispensed with. This is of advantage particularly because for reasons of hygiene it is not possible to readily obtain a required lid from the store. Specifically, a person filling the container would first have to remove their protective clothing prior to being able to go into the store. Also, it is often disruptive when the lid is stored loosely beside or close to the container as said lid may be damaged due to the busy ambience in a hospital environment, this being particularly applicable to the snap-fit hooks which are required for orderly closing of the container.

In order for the lid to be hooked into the container it suffices for the stacking male parts which are provided with a recess to be disposed on a narrow side of the lid. Alternatively, it is however also possible for said stacking male parts to be disposed on a longitudinal side of the lid, or in an encircling manner.

One advantageous refinement of the invention provides that the lid in mutually parallel sectional planes which each run so as to be perpendicular to the vertical axis of the former in each case has the shape of a preferably rounded rectangle, the stacking male parts and stacking female parts being disposed close to the preferably rounded corners of the rectangle.

It should finally be noted that the various features of the dependent claims in variants of the invention may each be implemented individually or in arbitrary combinations.

EXEMPLARY EMBODIMENT

Figure 3A:
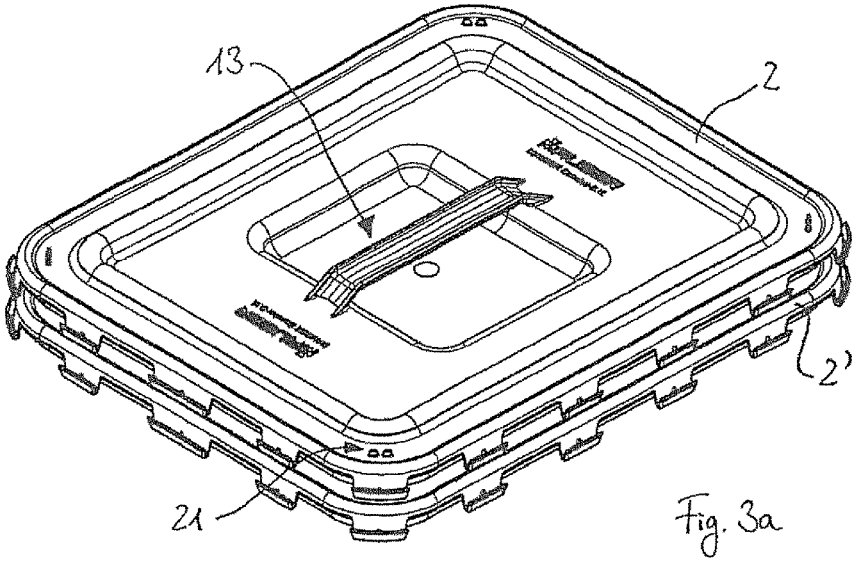
Figure 3B:
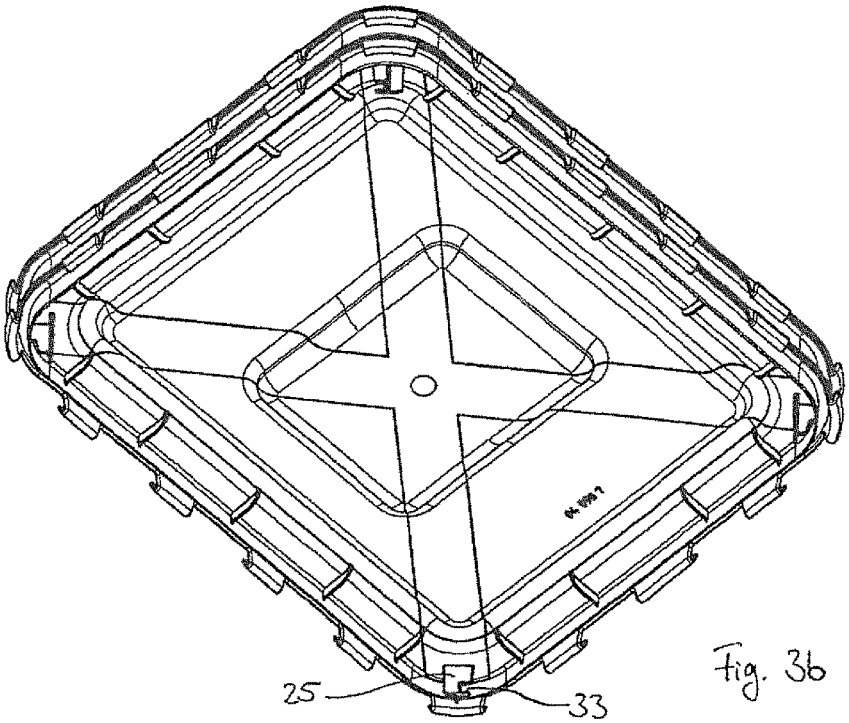
Figure 4A:
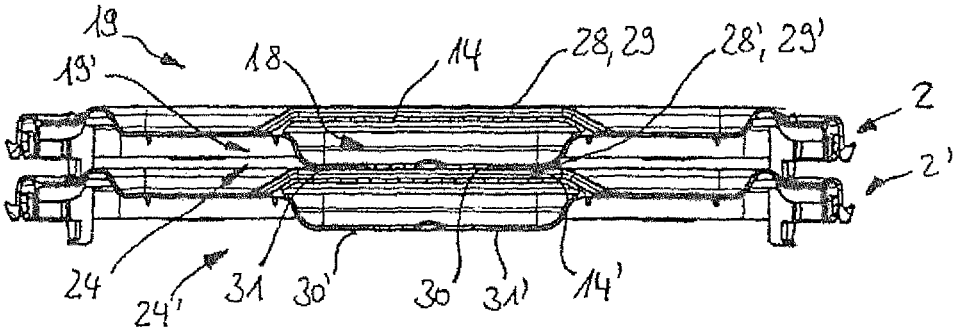
Figure 4B:
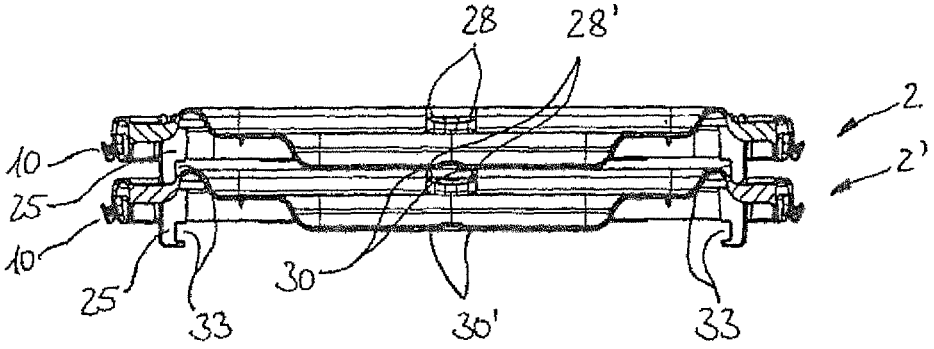

The invention described above will be discussed in more detail hereunder by means of an exemplary embodiment which is illustrated in the figures in which:

FIG. 1: shows a three-dimensional view of a container having a lid according to the invention;

FIGS. 2*a* to 2*f*: show views of the lid according to the invention from FIG. 1;

FIGS. 3*a* and 3*b*: show three-dimensional views of two stacked lids according to the invention from FIG. 1;

FIGS. 4*a* and 4*b*: show vertical sections through the stacked lids from FIG. 3*a;*

FIG. 5: shows a plan view of the lids from FIG. 3*a*; and

FIGS. 6 and 7: show vertical sections to FIG. 5.

FIG. 1 shows a container 1 having a lid 2 according to the invention, in a three-dimensional view, the container 1 having a base 4 which is aligned to the vertical axis 3 of the container 1, and a jacket 5 adjoining thereto in an encircling manner. The lid 2, which has a vertical axis 6 running so as to be parallel with the vertical axis 3 of the container 1, thus closes an opening cross section (not visible in FIG. 1) toward an interior space 7 of the container 1, the opening cross section being defined by an end 8 of the jacket 5 that faces away from the base 4. Furthermore, the lid 2 has snap-fit hooks 10 which are distributed in an encircling manner and disposed so as to be mutually spaced apart on a periphery 9 and which are latched in corresponding latching openings 11 in an outwardly projecting peripheral flange 12 of the container 1 such that movement of the lid 2 in the direction of the vertical axis 3 is impossible.

The lid 2 in a central region 13 thereof has a handle 14 which is configured so as to be lug-type and U-shaped in the cross section. According to the present exemplary embodiment, a central region 15 is elongate in the direction of a longitudinal axis 16 of the lid 2. The central region 15 in the direction of a transverse axis 17 of the lid 2 has a width of only a few centimeters, corresponding approximately to the width B of the handle 14. A depression 18 which permits comfortable gripping of the handle 14 with one hand is disposed below the handle 14.

It can furthermore be seen that both the container 1 as well as the lid 2 each have, in sectional planes which run so as to be perpendicular to the vertical axes 3, 6, a cross section in the form of a rounded rectangle. Stacking female parts 21 which are composed of two elevations 22 which are positioned so as to be mutually close, a slot 23 passing through therebetween, are located on an upper side 19 of the lid 2 in four rounded corners 20, so as to be close to the periphery. Here, the elevations 22 or the slots 23, respectively, each are aligned such that the longitudinal axes thereof form an angle $\alpha$ of 45° to the longitudinal axis 16 and to the transverse axis 17.

FIGS. 2*a* to 2*f* show the lid 2 according to the invention from FIG. 1 in a three-dimensional plan view, a three-dimensional view from below, a plan view, a view from below, a vertical section in the direction of the longitudinal axis 16 of said lid 2, and a vertical section in the direction of the transverse axis 17 of said lid 2.

Figures 2A, 2B, 2C, 2D, 2E, 2F:
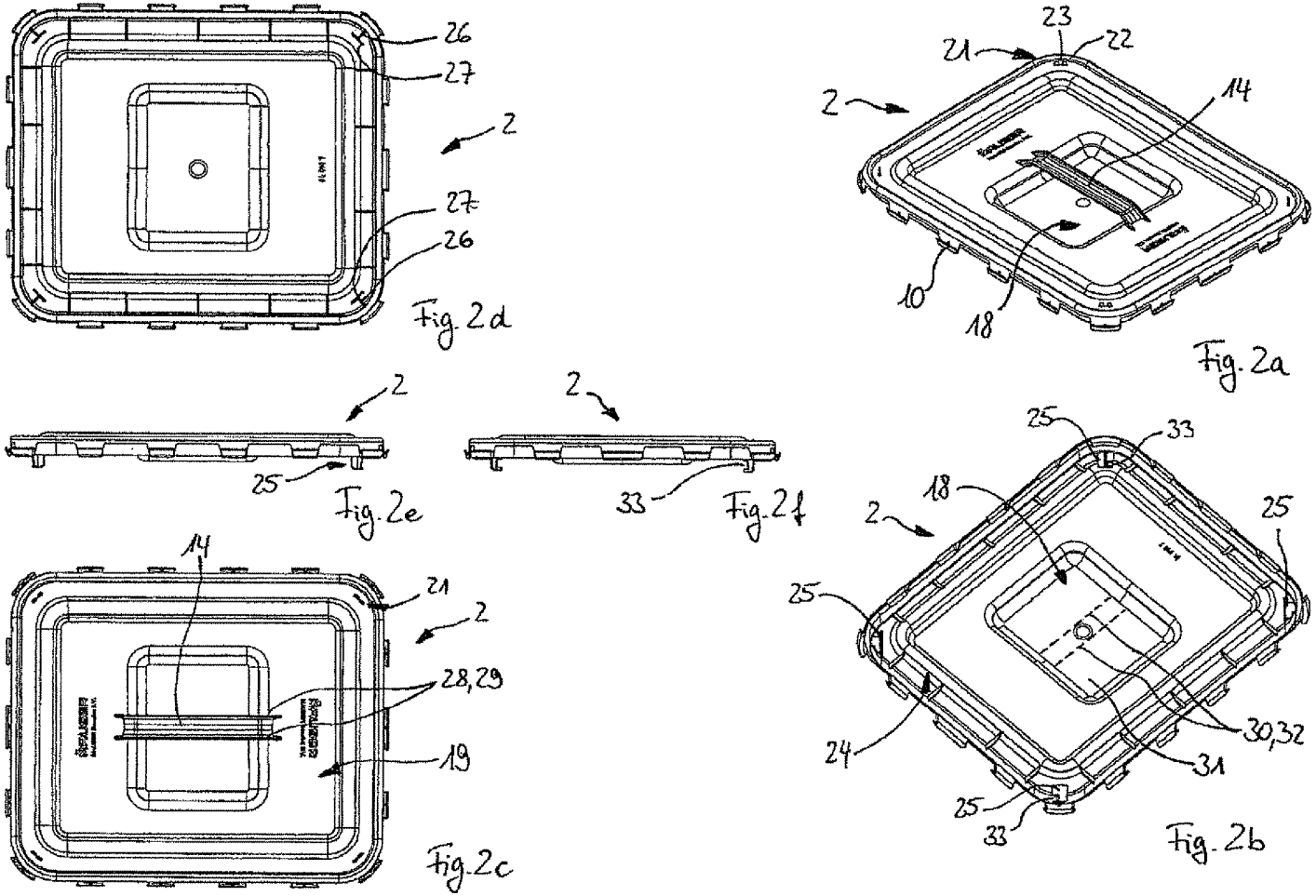

Apart from the fact that the container 1 is not illustrated, FIG. 2*a* corresponds to FIG. 1, the snap-fit hooks 10 thus being easier to identify. In the view of the lid 2 from below, which is illustrated in FIG. 2*b*, a lower side 24 of the lid 2, which in the four rounded corners 20 is in each case provided with a stacking male part 25 close to the periphery, can be seen. The stacking male parts 25 in the cross section each are molded so as to be T-shaped, thus each having one web 26 and one strap 27, the web 26 meeting the strap 27 centrically in an orthogonal manner. This geometry can be readily seen in FIG. 2*d*. If two or more lids 2 are stacked on top of one another the web 26 of the stacking male parts 25 of an upper lid 2 engages in the corresponding slots 23 of the stacking female parts 21 of a lower lid 2.

Moreover, in the case of two lids 2 being stacked, a contact area 28 on the upper side 19 of the lower lid 2, which is formed by two peripheries 29 of the handle 14 which is configured so as to be U-shaped, contacts a contact area 30 on the lower side 24 of the upper lid 2, which is formed by a lower side 31 of the depression 18, this contact being linear. The linear contact area 30 of the lower side 31 of the depression 18 is indicated by dashed lines 32 in FIG. 2*b*.

A recess 33 which is molded so as to be rectangular is incorporated into the strap 27 of the stacking male parts 25, in each case on a side which is directed toward the short peripheries 9 of the lid 2. On account thereof, the stacking male parts 25 are imparted the shape of a hook such that the former can be latched in the latching openings 11 or to the end 8 of the jacket 5 of a container 1, and such that the container 1 may also be provided with an associated lid 2 in the open state of the former. The configuration of the recess 28 is likewise readily identifiable in FIG. 2*f*.

Two stacked lids 2, 2' are shown in FIGS. 3*a* and 3*b*, once in a three-dimensional plan view and once in a three-dimensional view from below. On the one hand, the upper lid 2 by way of four stacking male parts 25 thereof bears on the upper side 19 of the lower lid 2', the web 26 of the stacking male part 25 engaging in the respective slot 23 of the stacking female parts 21, this however not being identifiable in FIG. 3 since the view is obscured by the upper lid 2. Moreover, the upper lid 2 in the central region 13 thereof, by way of the contact area 30 of the former on the lower side 24 of the former, bears on the assigned contact area 28 on the upper side 19' of the lower lid 2', this likewise not being identifiable in FIG. 3.

The contact areas 28, 28', 30, 30' can be seen in FIGS. 4*a* and 4*b* which show a vertical section in the longitudinal axis 16 and in the transverse axis 17 of the lids 2, 2', respectively. It can readily be seen that the contact face 30 on the lower side 24 of the upper lid 2 is formed by linear faces on the lower side 31 of the depression 18 that bear on the peripheries 29' of the handle 14' of the lower lid 2' that is configured so as to be U-shaped, the peripheries 29' defining the contact area 28' on the upper side 19' of the lower lid 2'. The snap-fit hooks 10 and the stacking male parts 25 are furthermore derived from FIGS. 4*a* and 4*b*.

FIG. 5 is composed of a plan view of the lids 2, 2' according to the invention from FIG. 3*a*, wherein the sectional planes VI-VI and VII-VII which are shown in FIGS. 6 and 7 are indicated. An elevation 22 of the stacking female part 21 each on the upper side 19, 19' of the lids 2, 2' can be identified in FIG. 6, wherein the web 26 and the strap 27 of the stacking male part 25 can furthermore be seen. The web 26 protrudes into the slot 23 of the stacking female part 21, which can be readily identified in particular in FIG. 7.

The invention claimed is:

1. A lid for a container, comprising:

snap-fit hooks distributed in a circumferential spaced-apart relation about a periphery of the lid for interlocking engagement in complementing latching openings distributed in circumferential spaced-apart relation about a periphery of an outwardly projecting flange of a jacket of the container to thereby establish a form-fit that prevents a movement of the lid in a direction of a vertical axis of the container; and stacking male parts or stacking female parts provided on a lower side of the lid in facing relationship to an interior space of the container and distributed about a circumference of the lid close to the periphery thereof to extend in a direction of the interior space of the container, when the container is closed by the lid, for engagement in complementing stacking female parts or stacking male parts on an upper side of a further said lid, when the lid and the further lid are stacked on top of one another, thereby establishing a form-fit that prevents a movement of the lid in a direction perpendicular to a vertical axis of the lid, which vertical axis of the lid is congruent with the vertical axis of the container, wherein each of the lower side of the lid and the upper side of the further lid, when stacked on top of one another, has a central region that forms a contact area via which compressive forces are transmissible in a direction of the vertical axis of the lid in the presence of a contact between the contact area of the lower side of the lid and the contact area of the upper side of the further lid.

2. The lid of claim 1, wherein the stacking male parts or stacking female parts and the contact area of the lower side of the lid have bearing faces which are located in a same plane that is perpendicular to the vertical axis of the lid.

3. The lid of claim 1, wherein the stacking male parts on the lower side of the lid have each a T-shaped cross section to define a free web for engagement in a corresponding one of slots of the stacking female parts on the upper side of the further lid.

4. The lid of claim 3, wherein the free web of each of the stacking male parts points away from the vertical axis of the lid and runs at an angle in relation to a transverse axis or to a longitudinal axis of the lid.

5. The lid of claim 4, wherein the angle is 40° to 50°.

6. The lid of claim 1, wherein the contact area in the central region on an upper side of the lid is formed by a handle to allow lifting of the lid or of the container, when closed by the lid.

7. The lid of claim 6, wherein the contact area in the central region on the lower side of the lid is formed by a lower side of a depression emanating from the upper side of the lid to enable engagement of the handle from below by hands.

8. The lid of claim 6, wherein the handle is configured to define two peripheries that establish two of said contact areas on the upper side of the further lid in parallel relationship for interaction with two of said contact area on the lower side of the lid.

9. The lid of claim 1, wherein the contact area of the lower side of the lid and the contact area of the upper side of the further lid have an elongate configuration.

10. The lid of claim 1, wherein at least one of the stacking male parts on the lower side of the lid includes a recess to allow the lid to be hooked into a latching opening in the peripheral flange of the container or on an end portion of the jacket of the container.

11. The lid of claim 10, wherein the at least one of the stacking male parts has a T-shaped cross-section to define a strap, said recess being formed in the strap.

12. The lid of claim 10, wherein the at least one of the stacking male parts is disposed on a narrow side of the lid.

13. The lid of claim 1, wherein the lid has a shape of a rectangle in mutually parallel sectional planes running perpendicular to the vertical axis of the lid, said stacking male parts and stacking female parts being disposed close to the corners of the rectangle.

14. The lid of claim 13, wherein the corners of the rectangle are rounded.

* * * * *